United States Patent [19]

Feldle et al.

[11] Patent Number: 4,536,128

[45] Date of Patent: Aug. 20, 1985

[54] BARREL HOUSING FOR CENTRIFUGAL FLUID MACHINES

[75] Inventors: Günter Feldle, St. Leon-Rot; Klaus Fischer, Neustadt, both of Fed. Rep. of Germany

[73] Assignee: Klein, Schanzlin & Becker Aktiengesellschaft, Frankenthal, Fed. Rep. of Germany

[21] Appl. No.: 522,059

[22] Filed: Aug. 10, 1983

[30] Foreign Application Priority Data

Aug. 31, 1982 [DE] Fed. Rep. of Germany ..... 3232326

[51] Int. Cl.[3] ..... F04D 29/42; B23K 31/02

[52] U.S. Cl. ..... 415/219 C; 219/76.1; 228/161; 228/174; 29/156.4 R

[58] Field of Search ..... 415/219 R, 219 A, 219 B, 415/219 C, 199.1, 199.2, 199.3, DIG. 5; 29/156.4 R; 228/153, 154, 160, 161, 174; 219/76.1, 76.14

[56] References Cited

U.S. PATENT DOCUMENTS

| | | | |
|---|---|---|---|
| 3,051,090 | 8/1962 | Zumbusch | 415/199.1 |
| 3,103,892 | 9/1963 | McFarland | 29/156.4 R |
| 3,153,383 | 10/1964 | Pilarczyk | 415/199.1 |
| 3,733,145 | 5/1973 | Kaplansky et al. | 415/199.1 X |
| 4,215,809 | 8/1980 | Davis | 219/76.14 X |
| 4,218,181 | 8/1980 | Komatsu et al. | 415/199.1 X |
| 4,307,995 | 12/1981 | Catterfeld | 415/199.1 |

FOREIGN PATENT DOCUMENTS

| | | | |
|---|---|---|---|
| 497356 | 12/1938 | United Kingdom | 228/174 |

*Primary Examiner*—Robert E. Garrett
*Assistant Examiner*—H. Edward Li
*Attorney, Agent, or Firm*—Peter K. Kontler

[57] ABSTRACT

The barrel housing of a multistage centrifugal pump has an elongated cylindrical main section and a discrete annular section which is inserted into one end portion and defines an annular shoulder facing the other end portion of the main section. The shoulder is engaged by the inner casing of the pump. The annular section can constitute a prefabricated component or is formed by cladding. The inlet opening of the housing is provided only in the one end portion of the main section, only in a portion of the annular section which extends outwardly beyond the one end portion of the main section, or is a composite opening having a first part in the one end portion of the main section and a registering second part in the annular section. The outlet opening for compressed fluid is provided in the other end portion of the main section.

19 Claims, 4 Drawing Figures

BARREL HOUSING FOR CENTRIFUGAL FLUID MACHINES

BACKGROUND OF THE INVENTION

The present invention relates to centrifugal flow machines in general, and more particularly to improvements in so-called outer casings or barrel type housings for use in multistage centrifugal pumps and analogous machines.

U.S. Pat. No. 3,153,383 granted Oct. 20, 1964 to Pilarczyk discloses a multistage centrifugal pump wherein the outer casing is a one-piece body, one end portion of which is formed with an inlet opening for admission of fluid to the first stage and another end portion of which has an outlet opening for evacuation of pressurized fluid which issues from the last stage. A similar outer casing is disclosed in U.S. Pat. No. 3,051,090 granted Aug. 28, 1962 to Zumbusch. The packages of stages which are utilized in the machines of these references are held together by elongated tie bolts, and the first stage abuts against an internal shoulder of the outer casing adjacent to the inlet opening. It is also known to hold the stages of a multistage centrifugal pump together by a cover serving to close that end of the outer casing which is adjacent to the outlet opening (i.e., to the last stage) and to urge the foremost stage against an internal shoulder of the outer casing. Thus, the shoulder serves to take up all forces which develop in the interior of the outer casing and are determined by the pressure of fluid in the machine as well as by the configuration and dimensions of the parts in the outer casing. It can be said that the plane including the internal shoulder of a conventional outer casing constitutes a partition between the low-pressure region which receives fluid from the inlet opening and the high-pressure region which admits pressurized fluid to the outlet opening. In order to ensure that the shoulder will be capable of standing the stresses which develop in the interior of the outer casing, the material around the shoulder must exhibit a certain thickness. Moreover, the shoulder determines the inner diameter of the outer casing. Therefore, the portion of the outer casing in the region of the inlet opening is normally much thicker than the portion which is adjacent to and defines the outlet opening even though the pressure at the outlet opening is much higher than the pressure at the inlet opening. The pressure at the outlet opening depends on the number of stages and on the design of stages in the outer casing. The making of a one-piece outer casing involves considerable waste in expensive metallic material and resort to complex material removing machines. Moreover, the outer casing is often too bulky and too heavy, and the assembly of the component parts therein by means of tie bolts takes up much time.

OBJECTS AND SUMMARY OF THE INVENTION

An object of the invention is to provide a simple, compact and inexpensive outer casing for use in centrifugal fluid machines, particularly in multistage centrifugal pumps.

Another object of the invention is to provide an outer casing which does not require a substantial amount of machining and which can be assembled of prefabricated components.

A further object of the invention is to provide an outer casing which can be utilized in practically all kinds of centrifugal fluid machines irrespective of the number of stages and/or the pressure of fluid at the outlet.

An additional object of the invention is to provide novel and improved prefabricated components or sections which can be used for assembly of the above outlined outer casing.

Still another object of the invention is to provide an outer casing whose dimensions can be selected with a view to avoid any waste in material without sacrificing the safety and reliability of the machine which utilizes the improved outer casing.

Another object of the invention is to provide an outer casing or barrel type housing which can be assembled with conventional stages of a multistage centrifugal pump or an analogous fluid machine.

A further object of the invention is to provide a novel and improved method of making an outer casing of the above outlined character.

Another object of the invention is to provide a method which involves a minimum of material removal from component parts of the outer casing and which can be practiced by resorting to relatively simple machines.

A further object of the invention is to provide a method of assembling the outer casing of a multistage centrifugal fluid machine from prefabricated components and with no waste or with minimal waste in metallic material.

One feature of the invention resides in the provision of an outer casing for use in centrifugal fluid machines, particularly in multistage centrifugal pumps. The improved outer casing comprises an elongated tubular main section having a first and a second end portion, a relatively short annular second section which is at least partially installed in the main section and has an end face or shoulder facing one of the two end portions of the main section, and means for securing the second section to the main section. The second section can be installed (either entirely or in part) in the first end portion of the main section so that its end face or shoulder faces the second end portion. The securing means can include one or more permanent bonds between the two sections. For example, each bond can constitute a welded connection between the two sections.

The one end portion is provided with an outlet opening for pressurized fluid which is to be discharged from the last stage of a multistage centrifugal pump if the improved structure constitutes the outer casing of such pump. The inlet opening can be provided in the other end portion of the main section. Alternatively, the inlet opening can be provided in the second section if a portion of the second section extends outwardly beyond the other end portion of the main section. Still further, the inlet opening can be a composite opening including a first part or opening in the other end portion of the main section and a registering second part or opening which is provided in the second section.

The thickness of the main section can exceed the thickness of the second section, and the axial length of the second section can be a small fraction of the axial length of the main section. Also, the thickness of the other end portion of the main section can exceed the thickness of the one end portion.

The outer casing of the present invention can further comprise a cover which can constitute the means for securing the second section to the other end portion of the main section or which simply performs a sealing action by abutting against the adjacent end face of the other end portion of the main section as well as against the adjacent second end face of the second section. The latter can be obtained by cladding, and the securing means then constitutes or includes the hardened material of the fillet or fillets which are applied to the internal surface of the main section in a suitable welding machine.

Another feature of the invention resides in the provision of a method of assembling the outer casing of a centrifugal fluid machine, particularly a multistage centrifugal pump. The method comprises the steps of inserting at least a portion of an annular section into an elongated tubular main section so that an end face of the inserted annular section faces toward one end portion of the main section, and securing the annular section to the main section against movement in a direction away from the one end portion of the main section. The securing step can comprise bonding the annular section to the main section by welding, soldering or an analogous technique. The inserting step can comprise positioning the remaining portion of the annular section outside of the other end portion of the main section, and the method can further comprise the steps of providing the remaining portion of the annular section with an inlet opening for admission of fluid into the first stage of a multistage centrifugal pump and providing the one end portion of the main section with an outlet opening for evacuation of pressurized fluid from the last stage of the pump.

Alternatively, the method can comprise the steps of depositing on the internal surface of a metallic tubular main casing section an annulus of molten metal (e.g., by cladding) so that the annulus exhibits an end face facing toward one end portion of the main section, and causing or allowing the molten metal to set so that the annulus is permanently bonded to the main section.

The novel features which are considered as characteristic of the invention are set forth in particular in the appended claims. The improved outer casing itself, however, both as to its construction and the mode of making or assembling the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
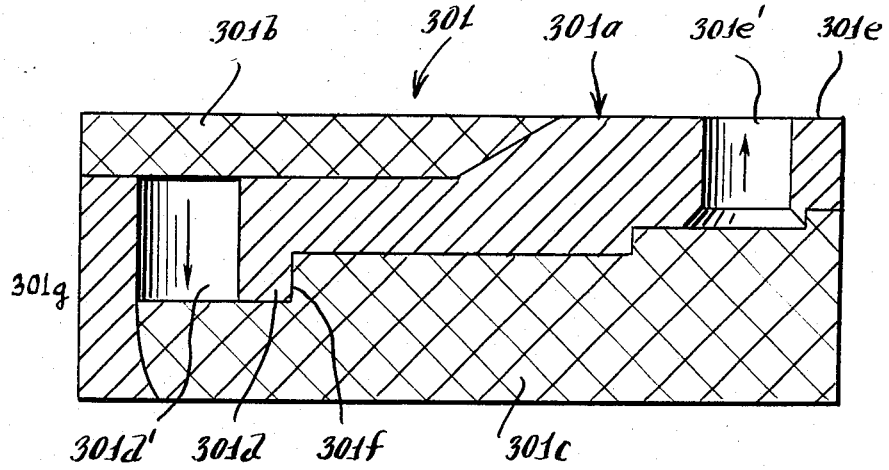
Fig. 1. (PRIOR ART)
FIG. 1 is an axial sectional view of a metallic blank which is convertible into one-half of a conventional outer casing by removing those portions of the blank which are provided with criss-cross hatching.

Referring first to FIG. 1, there is shown a portion of a metallic blank 301 which can be converted into one-half 301*a* of an outer casing of the type shown at 4 in FIG. 1 of the aforementioned U.S. Pat. No. 3,153,383 to Pilarczyk. The conversion involves removal of the portions 301*b* and 301*c* which are indicated by criss-cross hatching. This leaves the half casing 301*a* which must be provided with an inlet opening 301*d'* in an end portion 301*d* including an integral cover 301*g* and with an outlet-opening 301*e'* in the other end portion 301*e*. The reference character 301*f* denotes a part of an annular shoulder which serves as an abutment for the inner casing of the centrifugal pump. As shown in FIG. 1 of Pilarczyk, the shoulder 301*f* constitutes an abutment for the adjacent end diaphragm 18. Even if the outer casing of Pilarczyk is obtained by removing material from a modified blank, e.g., a blank which is formed by forging in such a way that the major portion of each of the two criss-cross hatched parts 301*b* and 301*c* is missing, this still necessitates extensive treatment in a material removing machine so that the outer housing is expensive and its machining takes up a considerable amount of time.

Figure 2:
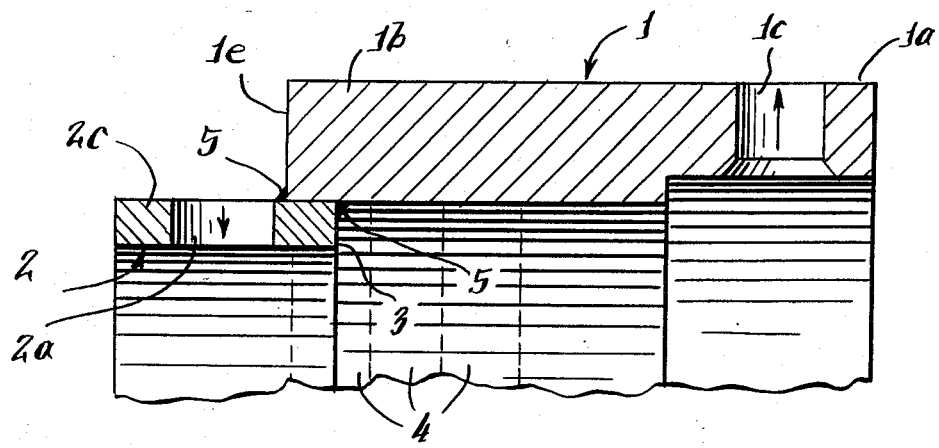
FIG. 2 is an axial sectional view of one-half of an outer casing which embodies one form of the invention, portions of three coaxial stages being indicated by broken lines.

FIG. 2 illustrates a portion of an outer casing or barrel type housing which is assembled in accordance with a first embodiment of the present invention. The outer casing comprises an elongated tubular main section 1 which is a hollow cylinder and whose internal and external surfaces can be adequately treated prior to permanently securing it to an annular second section 2. The tubular main section 1 has a relatively thin end portion 1*a* which is provided with a radially extending outlet opening 1*c* for evacuation of pressurized fluid from the last stage of the centrifugal pump, and a thicker end portion 1*b* which is remote from the outlet opening 1*c* and surrounds the right-hand portion of the annular second section 2. The remaining portion 2*c* of the annular second section 2 extends outwardly beyond the end portion 1*b* and is provided with a radial inlet opening 2*a* for admission of fluid into the first stage of the pump. That end face (3) of the annular section 2 which faces toward the end portion 1*a* of the tubular main section 1 constitutes a shoulder or stop for the nearest portion of the inner casing or for a component (particularly the housing) of the leftmost stage of the centrifugal pump. Three stages of the pump are shown schematically by broken lines, as at 4. The right-hand portion of the annular section 2 is secured to the end portion 1*b* by a first ring-shaped welded seam 5 which is adjacent to the end face 1*e* of the end portion 1*b*, and by a second ring-shaped welded seam 5 which is outwardly adjacent to the end face 3. The securing means including the two welded seams 5 not only ensures that the annular section 2 can stand pronounced stresses which tend to expel it from the end portion 1*b* of the main section 1 when the centrifugal pump is in actual use, but such seams also sealingly secure the right-hand portion of the section 2 to the end portion 1*b* of the main section 1 so that the fluid which is confined in the improved outer casing cannot escape along the internal surface of the section 1 all the way to the end face 1*e*.

It will be noted that the axial length of the tubular main section 1 greatly exceeds the axial length of the annular second section 2 and that the thickness of the end portion 1*b* of the section 1 can appreciably exceed the thickness of the section 2 (the thickness of the end portion 1*b* can but need not exceed the thickness of the end portion 1*a*). The portion 2*c* of the annular section 2 can be said to constitute a smaller-diameter coaxial extension of the main section 1 when the two sections are fixedly secured to each other. The illustrated securing means (the welded seams 5) can be replaced with other types of securing means, e.g., with an annulus of screws or bolts and nuts. Furthermore, the annular section 2 can be bonded to the section 1 and can be additionally secured thereto by several bolts and nuts, screws or other types of removable fastener means.

Figure 3:
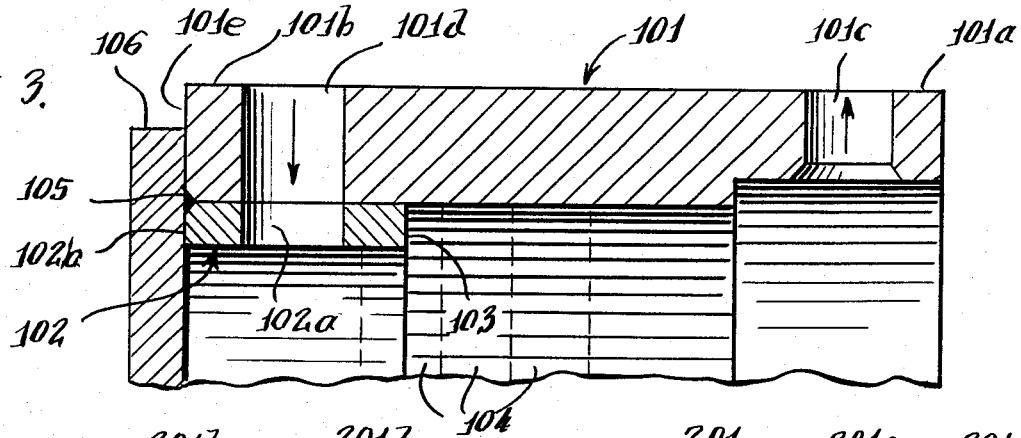
FIG. 3 is a similar axial sectional view of one-half of an outer casing which embodies another form of the invention, further showing a cover which abuts against the respective end faces of the two sections close to the inlet opening.

FIG. 3 illustrates a portion of a second outer casing wherein all such parts which are identical with or clearly analogous to the corresponding parts of the outer casing of FIG. 2 are denoted by similar reference characters plus 100. The main difference between the embodiments of FIGS. 2 and 3 is that the annular second section 102 of FIG. 3 is fully received in the respective end portion 101*b* of the tubular main section 101 and that the left-hand end face 102*b* of the section 102 is flush with the end face 101*e* of the end portion 101*b*. FIG. 3 further shows a cover 106 whose inner side abuts against the end faces 102*b* and 101*e*. The inlet opening of the outer casing which is shown in FIG. 3 is a composite opening including a part 101*d* which is provided in the end portion 101*b* and a part 102*a* which is provided in the section 102 and registers with the part 101*d*. The end face 103 of the section 102 serves as a shoulder or stop for the casing of the leftmost stage 104. The section 102 is secured to the end portion 101*b* of the section 101 by a single ring-shaped welded seam 105 which may but need not necessarily perform the function of a seal because the sealing action can be taken over by the cover 106. Inversely, the welded seam 105 can perform exclusively a sealing action and the section 102 is then held against axial movement in a direction to the left as soon as the cover 106 is properly affixed to the main section 101 in a manner which is not specifically shown in the drawing. If the cover 106 is not designed to perform a sealing function and/or to hold the section 102 against axial movement in the section 101, the means for securing the section 102 to the end portion 101*b* of the section 101 must perform a sealing action and must also enable the section 102 to resist stresses which develop when the centrifugal pump is in use and which tend to expel the section 102 from the section 101.

The section 102 can be welded to the section 101 inwardly of the inlet opening 101*d*. The opening 102*a* is then omitted and the section 102 is welded to the end portion 101*b* in such a way that the securing means can furnish an adequate sealing action and that such securing means can also prevent axial shifting of the section 102 in response to the development of forces which are applied to its end face 103.

Each of the sections 1, 101 can constitute a piece of prefabricated cylindrical metallic stock which is adequately finished at the inside and/or at the outside prior to subdivision into sections of requisite length. The same holds true for the sections 2 and 102, i.e., each of these sections can be mass-produced and finished at all sides prior to securing it to the respective main section. This ensures that the assembled outer casing of FIG. 2 or 3 does not require any secondary treatment or that the extent of secondary treatment is negligible and contributes very little to the overall cost of the outer casing. The section 1, 101, 2 and/or 102 can be made of prefabricated cast, forged or rolled stock.

It is further possible to omit the welded seams 5 and/or the seam 105 and to dispense with the aforementioned screws, bolts and nuts and/or analogous separable fastener means and to furnish the main section 1 or 101 with a prefabricated internal shoulder which is strong enough to serve as an abutment for the section 2 or 102. The thickness of such internal shoulder on the section 1 or 101 can be a small fraction of the thickness of the section 2 or 102. It is advisable that the strength of the material of the annular section 2 or 102 at least match the strength of the material of the part which abuts against its end face 3 or 103 when the outer casing of the present invention is assembled with other parts of a multistage centrifugal pump or an analogous fluid machine. This is desirable because the section 2 or 102 must take up all stresses which act in the axial direction of the pump when the latter is in actual use and the leftmost stage bears against the adjacent end face (3 or 103) of the annular section 2 or 102.

Figure 4:
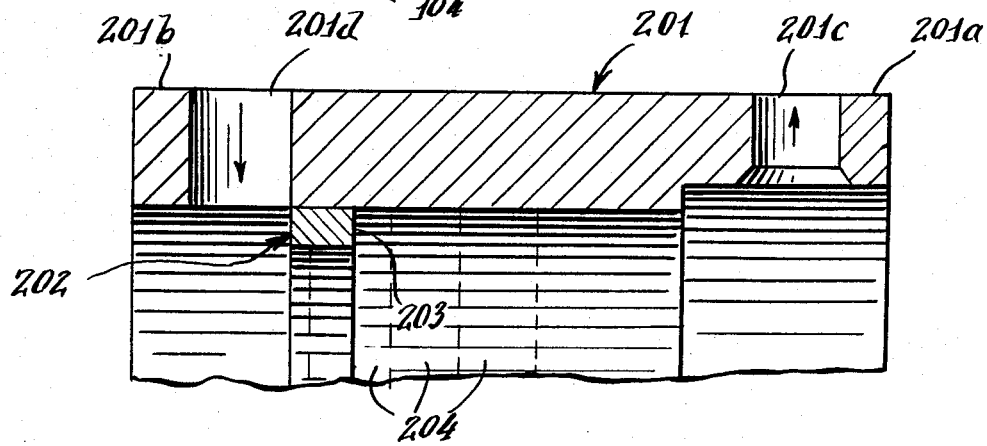
FIG. 4 is a similar axial sectional view of one-half of an outer casing which embodies an additional form of the invention and wherein the annular section is formed by cladding.

FIG. 4 illustrates a portion of a third outer casing which embodies the present invention. All such parts of this outer casing which are identical with or clearly analogous to the corresponding parts of the casing of FIG. 2 are denoted by similar reference characters plus 200. The main difference is that the second section 202 is an annulus which is obtained by cladding, i.e., by deposition of one or more fillets of molten metal on the internal surface of the main section 201 inwardly adjacent to an inlet opening 201*d* which is provided in the end portion 201*b* of the tubular main section 201. When the material of the thus deposited metal sets, the resulting annular section 202 can be treated in a suitable machine to provide an adequate end face 203 which serves as a shoulder or stop for the casing of the nearest stage 204. The material which is disposed between the external surface of the section 202 and the corresponding portion of the internal surface of the section 201 can be said to constitute a means for securing the section 202 to the end portion 201*b* of the section 201. Such securing means is formed in automatic response to deposition of molten metal along the internal surface of the main section 201. Other welding techniques can be employed with equal or similar advantage as long as they can ensure the formation of an annular section 202 capable of standing axial stresses which are applied by the package of stages in the interior of the outer casing, and as long as such second section prevents the penetration of fluid between its outermost portion and the adjacent portion of the internal surface of the main section 201. The dimensions of the annular second section 202 depend upon the material which is used for cladding, on the characteristics of the material of the main section 201, and on anticipated pressures in the outer casing.

At least in many instances, the cost of the outer casing which is shown in FIG. 4 is even less than the cost of the outer casing which is assembled of prefabricated main and second sections in a manner as described in connection with FIGS. 2 and 3.

An important advantage of the improved outer casing or barrel type housing is that its cost is but a fraction of the cost of a conventional outer casing. This is attributable to the fact that the main section 1, 101 or 201 can constitute a piece of commercially available piping which is adequately finished at the inside and/or at the outside prior to conversion into a section of the outer casing. Also, and if the improved outer casing employs prefabricated annular sections (such as 2 or 102), these sections can be mass-produced at a minute fraction of the cost which is involved in converting a portion of the blank shown in FIG. 1 into an internal ring which exhibits an end face (301*f*) for the casing or housing of the adjacent stage of the pump. Furthermore, the strength, sealing action and other desirable characteristics of the outer casing which is shown in FIG. 2, 3 or 4 are or can be at least as satisfactory as the corresponding characteristics of a casing which is produced in accordance with conventional methods. The extent of machining which is required in connection with the making of the improved outer casing is but a minute fraction of the extent of machining which is required to convert the blank of FIG. 1 into a portion of outer casing for use in a multistage centrifugal pump or an analogous fluid machine. The welding operations which are involved in securing the section 2 or 102 to the respective main section 1 or 101, or which are involved to form the section 202 on the internal surface of the end portion 201*b* of the main section, are much less expensive and much less time-consuming than the machining of a blank of the type shown in FIG. 1.

The thickness of the main section 1, 101 or 201 of the improved composite outer casing can be a relatively small fraction of the thickness of the corresponding portion or section of a conventional one-piece casing, e.g., an outer casing which is obtained from a blank corresponding to that shown in FIG. 1. The material and/or the thickness of the main section and/or of the annular second section of the improved outer casing will be selected in dependency on anticipated pressures when the fluid machine is in use, on the number of stages in the interior of the casing, and/or on the overall dimensions of the machine. It has been found that, under all circumstances (i.e., by fully considering the anticipated pressures at the outlet of the machine employing the improved outer casing, the length of the outer casing, the overall dimensions of the machine and the number of stages in the interior of the casing), the cost of machining the parts of the improved outer casing and/or the fully assembled outer casing as well as of assembling the main and second sections is a very small fraction of the cost of making outer casings for multistage centrifugal pumps or the like in accordance with presently known techniques.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. An outer casing for a fluid-conveying unit of a centrifugal fluid machine, particularly for a multistage pumping unit of a centrifugal pump, comprising a tubular main section having a first and a second end portion; an annular second section at least partially installed in said main section, said second section having an end face facing one of said end portions, and said end face constituting an abutment for the fluid-conveying unit of the centrifugal fluid machine, said main and second sections constituting two different bodies; and means for securing said second section to said main section, said securing means including a permanent bond between said sections.

2. The outer casing of claim 1, wherein said second section is installed in the first end portion and said end face thereof faces the second end portion of said main section.

3. The outer casing of claim 1, wherein said bond constitutes a welded connection between said sections.

4. The outer casing of claim 1, wherein said one end portion has an outlet opening for pressurized fluid and the other of said end portions has an inlet opening for admission of fluid into said casing.

5. The outer casing of claim 1, wherein said one end portion has an outlet opening for pressurized fluid and said second section has an inlet opening for admission of fluid into said casing.

6. The outer casing of claim 1, wherein said one end portion has an outlet opening for pressurized fluid and said second section and the other of said end portions have registering inlet openings for admission of fluid into said casing.

7. The outer casing of claim 1, wherein the thickness of said main section exceeds the thickness of said second section.

8. The outer casing of claim 1, wherein the axial length of said second section is a small fraction of the axial length of said main section.

9. The outer casing of claim 1, wherein a portion of said second section extends beyond the other of said end portions.

10. The outer casing of claim 1, wherein the thickness of the other of said end portions exceeds the thickness of said one end portion and of said second section.

11. The outer casing of claim 1, wherein the other of said end portions has an end face and said second section has a second end face which is at least substantially flush with the end face of said other end portion; and further comprising a cover adjacent to the end face of said other end portion and said second end face.

12. The outer casing of claim 1, wherein said second section is disposed in the region of said first end portion, and said end face of said second section faces said second end portion, said first end portion including a fluid inlet, and said second end portion including a fluid outlet.

13. An outer casing for a fluid-conveying unit of a centrifugal fluid machine, particularly for a multistage pumping unit of a centrifugal pump, comprising a tubular main section having a first and a second end portion; an annular second section at least partially installed in said main section, said second section being formed by cladding and having an end face facing one of said end portions, said end face constituting an abutment for the fluid-conveying unit of the centrifugal fluid machine, said main and second sections constituting two different bodies; and means for securing said second section to said main section, said securing means providing a permanent bond between said sections.

14. A method of making an outer casing for a fluid-conveying unit of a centrifugal fluid machine, particularly for a multistage pumping unit of a centrifugal pump, comprising the steps of providing a tubular main body capable of receiving the fluid-conveying unit of the centrifugal fluid machine; and forming an abutment for the fluid-conveying unit internally of said main body by joining the latter to a different annular body at least a portion of which is located inside said main body, said forming step comprising permanently securing said annular body to said main body.

15. The method of claim 14, wherein said securing step comprises bonding the annular body to the main body.

16. The method of claim 14, wherein said forming step further comprises inserting said portion of said annular body into said tubular body.

17. The method of claim 16, wherein said inserting step includes positioning the remaining portion of the annular body outside of the main body; and further comprising the steps of providing the remaining portion of the annular body with an inlet opening for admission of fluid into the casing, and providing the main body with an outlet opening for evacuation of pressurized fluid from the casing.

18. A method of making an outer casing for a fluid-conveying unit of a centrifugal fluid machine, particularly for a multistage pumping unit of a centrifugal pump, comprising the steps of:

(a) providing a tubular metallic body capable of receiving the fluid-conveying unit of the centrifugal fluid machine;

(b) forming an abutment for the fluid-conveying unit by depositing an annulus of molten metal on the internal surface of said tubular body; and (c) causing said molten metal to solidify so that said annulus is permanently bonded to said tubular body.

19. A method of making an outer casing for a fluid-conveying unit of a centrifugal fluid machine, particularly for a multistage pumping unit of a centrifugal pump, comprising the steps of providing a tubular main body capable of receiving the fluid-conveying unit of the centrifugal fluid machine; and forming an abutment for the fluid-conveying unit internally of said main body by joining the latter to a different annular body at least a portion of which is located inside said main body, said forming step comprising depositing an annulus of molten material on the internal surface of said main body.

* * * * *